US006536180B1

(12) United States Patent
Rosenblat et al.

(10) Patent No.: US 6,536,180 B1
(45) Date of Patent: Mar. 25, 2003

(54) TWISTED WIRE TIE

(75) Inventors: Michael Rosenblat, Winnipeg (CA); Andrew Lamothe, Winnipeg (CA)

(73) Assignee: MSR Manufacturing Ltd.., Winnipeg (CA)

( * ) Notice: Subject to any disclaimer, the term of this patent is extended or adjusted under 35 U.S.C. 154(b) by 0 days.

(21) Appl. No.: 09/975,016

(22) Filed: Oct. 12, 2001

(51) Int. Cl.[7] ..... E04C 5/16

(52) U.S. Cl. ..... 52/712; 52/699; 52/714; 52/426; 52/562; 52/568; 249/215

(58) Field of Search ..... 52/699, 712, 714, 52/426, 428, 438, 442, 562, 565, 568; 249/215

(56) References Cited

U.S. PATENT DOCUMENTS

| | | | | | |
|---|---|---|---|---|---|
| 809,231 | A | * | 1/1906 | Thines | 52/712 |
| 1,262,212 | A | * | 4/1918 | Kosack | 52/481.1 |
| 1,692,166 | A | | 11/1928 | Gates | |
| 1,692,167 | A | | 11/1928 | Gates | |
| 1,924,631 | A | * | 8/1933 | Toogood | 249/215 |
| 2,329,550 | A | * | 9/1943 | Mentesana et al. | 52/703 |
| 2,656,581 | A | | 10/1953 | Gates | |
| 2,959,835 | A | * | 11/1960 | Gates | 249/215 |
| 3,168,912 | A | | 2/1965 | Marica | |
| 3,411,742 | A | | 11/1968 | McArdle | |
| 3,514,070 | A | | 5/1970 | McArdle | |
| 3,728,836 | A | | 4/1973 | Gates | |
| D228,488 | S | | 10/1973 | Gates | |
| 4,240,233 | A | * | 12/1980 | Vercelletto | 52/127.3 |
| D300,117 | S | | 3/1989 | Gates | |

FOREIGN PATENT DOCUMENTS

| | | | | |
|---|---|---|---|---|
| CA | 979625 | | 12/1975 | |
| CA | 1046248 | | 1/1979 | |
| GB | 8511 | * | 4/1895 | 52/712 |
| GB | 2096664 A | * | 10/1982 | 52/714 |

OTHER PUBLICATIONS

Gates & Sons, Inc., Gates Concrete Forming Systems, internet information downloaded Aug. 28, 2001 Denver, USA Copyright 1997, 1998, 1999, 2000.

* cited by examiner

*Primary Examiner*—Carl D. Friedman
*Assistant Examiner*—Brian E. Glessner
(74) *Attorney, Agent, or Firm*—Aikins, MacAulay & Thorvaldson; Murray E. Thrift

(57) ABSTRACT

A twisted wire tie for concrete forming has an elongate loop with a single strand of wire on one side and a twisted double strand on the opposite side. Two stops on the tie are formed at opposite ends of the twisted double strand and engage the twisted strand and the single strand so as to prevent unwinding of the twisted strand when the tie is placed in tension.

5 Claims, 1 Drawing Sheet

TWISTED WIRE TIE

FIELD OF THE INVENTION

The present invention relates to wire ties for concrete forms.

BACKGROUND

Wire ties are used for spacing the panels used in poured concrete forms. The ties provide the correct spacing of the panels and may be used to support reinforcement bars (rebar). When the concrete is set and the form panels are removed, the ends of the ties projecting from the concrete are removed.

The wire ties in common use include the tie disclosed in U.S. Pat. No. 1,692,166 issued Nov. 20, 1928, to L. O. Gates, and U.S. Pat. No. 3,168,912 issued Feb. 9, 1965, to G. E. Marica. The Gates tie has a single wire formed into a three-strand, twisted cable at the center, retainer loops at each end and transverse stops between the retainer loops and the center section.

A tie that is intended to address certain limitations of this prior art tie is disclosed in U.S. Pat. No. 3,722,836 issued Apr. 24, 1973, to R. C. Gates. This tie is a single strand formed into a loop with a single strand on one side, a twisted double strand cable on the other side and return bends at opposite ends as retainer loops. The ends of the wire are formed into rebar saddles on the twisted side of the loop, facing away from the single strand side of the loop. With a tie of this type, sufficient tension applied to the tie will cause the twisted strand to "unwind", stretching the overall length of the tie and allowing the form panels to separate to an unacceptable extent. This tie is not used commonly, if at all.

Another loop type tie that eliminates the twisted side of the loop is disclosed in U.S. design Pat. Des. 300,117 issued Mar. 7, 1989, to H. Gordon Gates. In that tie, one end of the wire strand is crossed over from one side of the loop to the other midway between the ends, and the ends are welded to the respective sides of the loop. It is believed that the welding of the tie should be avoided. These welds are in shear and must be carefully made in order to avoid breakage with consequent failure of the tie. The stops of this tie are on opposite sides of the loop, so that they cannot be used in locating rebar for both sides of a concrete panel to be formed.

The present invention is concerned with the provision of an improved, twisted, loop type tie that is resistant to the unwinding of the prior art, twisted loop tie.

SUMMARY

According to the present invention there is provided a wire tie for concrete forms comprising a length of wire having:

- a center section formed to provide an elongate loop with:
  - a first side;
  - a second side with overlapping strands twisted together; and
  - reverse bends between the first and second sides of the loop; and
- two end sections at opposite ends of the second side of the loop, each end section being formed into an anti-rotation stop extending from a respective end of the twisted second side of the loop and engaging the first side of the loop so as to prevent rotation of the stops relative to the loop.

Bringing the ends of the wire across the loop to engage both sides of the loop in a manner that prevents untwisting of the twisted side overcomes the main difficulty with the prior art tie. This may be achieved by having the stops project from the ends of the twisted second side of the loop on one face of the loop and cross over to engage the first side of the loop on the opposite face of the loop.

In preferred embodiments, the stops are formed into a U-shaped configuration with one arm that projects from the twisted second side of the loop, across the untwisted first side and a second arm that returns across both sides of the loop. This not only provides the stop function of the tie to position the forming panels properly with respect to the tie, it also provides a seat for the positioning of rebar at the intersection of the stop and the untwisted first side of the tie. At least one of the two arms of the U-shaped stops desirably cross over the two sides of the loop on opposite faces of the loop to provide an interlock preventing the unwinding of the twisted side of the loop.

BRIEF DESCRIPTION OF THE DRAWINGS

In the accompanying drawings, which illustrate an exemplary embodiment of the present invention.

DETAILED DESCRIPTION

Figure 1:
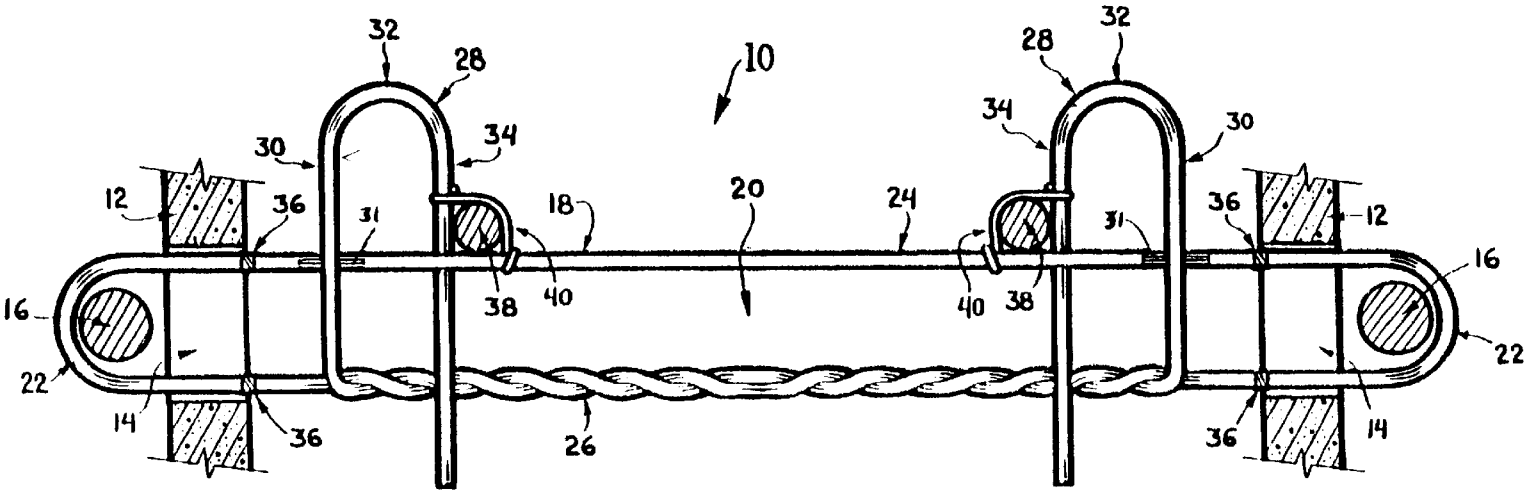
FIG. 1 is a vertical section showing a tie according to the present invention in association with form panels and tie rods.
Figure 2:
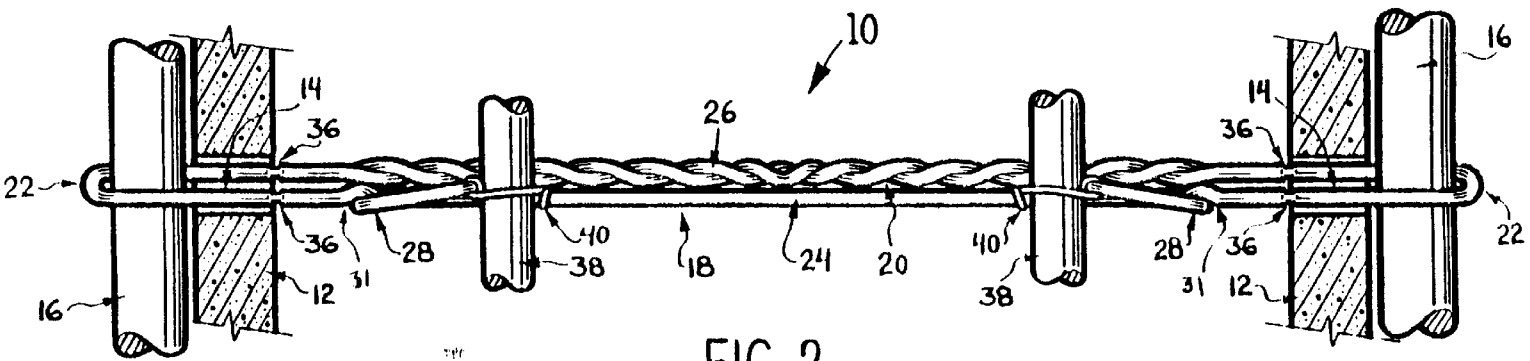
FIG. 2 is a horizontal section showing the assembly of FIG. 1.

Referring to the accompanying drawings, there is illustrated a wire tie 10 for use with two concrete form panels 12. The panels are, in use, spaced apart by a predetermined distance and held in place using the tie. For this purpose, each form panel has a slot 14 through which a respective end of the tie 10 projects to be engaged by a tie bar 16 on the outside of the panel 12.

The tie 10 is formed from a single length of wire 18. A center section of the wire is formed into a closed loop 20 with the opposite ends of the loop being reverse bends 22. On one side of the loop is a single strand of wire 24 while on the other side the wire is overlapped and twisted to provide a twisted double strand or cable 26. At the ends of the twisted cable 26 the end sections of the wire 18 are formed into U-shaped stops 28. Each stop has an arm 30 that extends from the end of the twisted section of the loop, across one face of the loop 20 where it merges into a reverse bend 32. The second arm 34 of the U-shaped stop 28 extends across the single strand 24 on the opposite face of the loop, and then returns to the first face of the loop where it crosses the twisted double strand 26. This weaving of the stop through the loop prevents untwisting of the twisted side of the loop when tension is placed on the tie.

Where the arm 30 of the stop crosses the single-strand 24, the single-strand has a bend 31 of generally V-shape in which the arm 30 is engaged. This prevents rotation over the strand 24 when the ends of the tie are being removed.

Between the ends 22 of the loop and the two sides 24 and 26, the wire has notches 36 that provide sites where the wire can be broken off readily once the concrete is set and the form panels 12 have been removed. During this process, the bend 31 prevents rotation over the strand 24, so that it can be broken off at the notch 36. The two stops 28 are used not only to limit the travel of the form panels 12 towards one another but also to locate the rebars 38 that reinforce the concrete. A rebar is located at the innermost intersection of each stop with the upper side of the loop and is tied in place by a wire tie 40.

While one embodiment of the present invention has been described in the foregoing, it is to be understood that other embodiments are possible within the scope of the invention and are intended to be included herein. The invention is thus to be considered limited solely by the scope of the appended claims.

We claim:

1. A wire tie for concrete forms comprising a length of wire having:

a center section formed to provide an elongate loop with:

a first side;

a second side with overlapping strands twisted together; and reverse bends between the first and second sides of the loop; and two end sections at opposite ends of the second side of the loop, each end section being formed into an anti-rotation stop Tending from a respective end of the twisted second side of the loop and engaging the first side of the loop so as to prevent rotation of the stops relative to the loop.

2. A wire tie according to claim 1 wherein the stops are substantially U-shaped.

3. A wire tie according to claim 1 wherein the stops extend from the twisted second side of the loop on one face of the loop and engage the first side of the loop on the opposite face.

4. A wire tie according to claim 2 wherein one arm of each U-shaped stop extends from one face of the elongate loop, across the first side of the loop on said one face of the loop, and the other arm extends across the first side of the loop on the opposite face of the loop and across the twisted second side of the loop on said one face of the loop.

5. A wire tie according to claim 1 wherein the twisted second side of the loop is twisted in opposite directions from opposite ends towards the center of the twisted side of the loop.

* * * * *